US010072427B2

(12) United States Patent
Smith

(10) Patent No.: US 10,072,427 B2
(45) Date of Patent: Sep. 11, 2018

(54) ABRADING DEVICE AND METHOD OF ABRADING A FLOOR STRUCTURE UTILIZING THE SAME

(71) Applicant: AWI LICENSING COMPANY, Wilmington, DE (US)

(72) Inventor: W. Steven Smith, Cornelius, NC (US)

(73) Assignee: AFI Licensing LLC, Lancaster, PA (US)

( * ) Notice: Subject to any disclaimer, the term of this patent is extended or adjusted under 35 U.S.C. 154(b) by 194 days.

(21) Appl. No.: 14/458,103

(22) Filed: Aug. 12, 2014

(65) Prior Publication Data

US 2014/0352245 A1 Dec. 4, 2014

Related U.S. Application Data

(63) Continuation-in-part of application No. 12/825,448, filed on Jun. 29, 2010, now Pat. No. 8,801,505.

(51) Int. Cl.
*E04F 15/04* (2006.01)
*B24B 21/22* (2006.01)
(Continued)

(52) U.S. Cl.
CPC ..... *E04F 15/02161* (2013.01); *B24B 1/007* (2013.01); *B24B 21/12* (2013.01); *B24B 21/22* (2013.01); *E04F 15/04* (2013.01)

(58) Field of Classification Search
CPC ... E04F 15/02161; E04F 15/04; E04F 15/107; E04F 15/02172; E04F 15/02188;
(Continued)

(56) References Cited

U.S. PATENT DOCUMENTS 1,374,194 A 4/1921 Furber
1,629,742 A * 5/1927 Scott ..... B27B 5/02 144/136.1
(Continued)

FOREIGN PATENT DOCUMENTS

EP 1053827 B1 10/2002
EP 1852229 A2 * 11/2007 ..... B27M 1/003
KR 10-2009-003769 1/2009

OTHER PUBLICATIONS

Homerwood, Experience the Sophistication of Authentic Amish Hand-crafted Hardwood; Brochure; 2008:12 pages.

*Primary Examiner* — Christopher M Koehler
*Assistant Examiner* — Joel Crandall

(57) ABSTRACT

An abrading device for abrading a floor structure comprises a first abrading assembly and a second abrading assembly. The first and second abrading assemblies each have a rotationally driven contact roll provided with a sleeve having a plurality of cutouts formed in a pattern thereon. An abrading belt is trained over the sleeve. A first oscillation assembly is connected to the first abrading assembly and oscillates the contact roll of the first abrading assembly in a first direction via a linear, reciprocating motion. A second oscillation assembly is connected to the second abrading assembly and oscillates the contact roll of the second abrading assembly in a second direction via a linear reciprocating motion. The first and second abrading assemblies consecutively abrade a top surface of the floor structure with the pattern formed by the cutouts on the respective sleeves to form a distressed visible pattern thereon.

20 Claims, 5 Drawing Sheets

(51) Int. Cl.
*E04F 15/02* (2006.01)
*B24B 21/12* (2006.01)
*B24B 1/00* (2006.01)

(58) Field of Classification Search
CPC ... E04F 13/10; E04F 13/0864; E04F 13/0871; E04F 13/0873; B27M 1/02; B27M 1/08; B27M 1/003; B27M 1/00; B44F 9/02; B44F 9/04; B28B 11/0863; B24B 21/22; B24B 1/007
See application file for complete search history.

(56) References Cited

U.S. PATENT DOCUMENTS 1,669,989 A 5/1928 Madsen
1,927,330 A 9/1933 Williams
2,162,279 A 6/1939 Herchenrider
2,231,921 A 2/1941 Kitlar et al.
2,565,036 A 8/1951 MacDonald
2,634,534 A 4/1953 Brown
2,651,150 A 9/1953 De Florez et al.
2,706,355 A 4/1955 Brown
2,706,873 A 4/1955 Gifford
2,720,061 A 10/1955 Anderson
2,791,070 A 5/1957 Schaller
3,074,210 A 1/1963 Eschenburg et al.
3,081,159 A 3/1963 Brown
3,146,556 A 9/1964 Schuster
3,151,700 A 10/1964 Feid
3,167,889 A 2/1965 Jacobi
3,214,870 A 11/1965 Elmendorf
3,299,921 A 1/1967 Jones
3,339,319 A 9/1967 Schuster et al.
3,418,195 A 12/1968 Allan
3,553,899 A 1/1971 Hasegawa
3,616,103 A 10/1971 Greiner et al.
3,701,219 A 10/1972 Sternal
3,703,198 A 11/1972 Luebs et al.
3,961,108 A 6/1976 Rosner et al.
4,038,784 A 8/1977 Grivna
4,084,356 A 4/1978 Brears
4,361,986 A 12/1982 van der Linden
4,635,405 A 1/1987 Stump
4,742,650 A 5/1988 Sauder et al.
4,945,959 A 8/1990 Biedenbach
5,271,699 A 12/1993 Barre et al.
5,733,180 A 3/1998 Kilde
6,089,958 A 7/2000 Costa et al.
6,299,512 B1 10/2001 Costa et al.
6,913,512 B2 7/2005 Grivna
7,101,270 B2 9/2006 Bau' et al.
7,108,031 B1 * 9/2006 Secrest ..... B27M 1/003 144/1.1
7,198,557 B2 4/2007 Haney
7,322,875 B1 1/2008 Lou
8,051,886 B2 11/2011 Tappan et al.
2003/0205018 A1 * 11/2003 Bentham ..... E04F 13/12 52/592.1
2004/0157539 A1 8/2004 Stenftenagel et al.
2005/0055937 A1 * 3/2005 Zimmerle ..... E01C 11/229 52/506.01
2008/0005988 A1 * 1/2008 Dombowsky ..... B44C 3/123 52/314

* cited by examiner

ABRADING DEVICE AND METHOD OF ABRADING A FLOOR STRUCTURE UTILIZING THE SAME

CROSS-REFERENCE TO RELATED PATENT APPLICATIONS

The present application is a continuation-in-part of U.S. patent application Ser. No. 12/825,448, filed Jun. 29, 2010, the entirety of which is incorporated herein by reference.

FIELD

The present invention relates to an abrading device for abrading a substantially planar wood structure, such as a solid hardwood or engineered hardwood floor structure, and a method of abrading the same.

BACKGROUND

It is known to hand scrape a top surface of a floor structure, such as a solid hardwood or engineered hardwood floor structure, to create a distressed visible pattern on the top surface thereof. This process is both time consuming and costly, because each of the floor structures must be hand-sculpted one at a time. It is therefore desirable to develop an abrading device that can quickly and cost effectively abrade the top surface of the floor structure while still providing an authentic distressed appearance on the top surface thereof.

BRIEF SUMMARY

The invention relates to a floor panel having a machine-imparted distressed visible pattern, the floor panel comprising a body extending along a longitudinal axis. The body comprises a bottom surface and a top surface, and the top surface has the machine imparted distressed visible pattern. The machine-imparted distressed visible pattern comprises a plurality of raised portion sets. Each of the plurality of raised portion sets comprising a plurality of elongated longitudinal raised portions that extend substantially parallel to one another and a plurality of elongated longitudinal recessed portions. The plurality of elongated longitudinal raised portions and the plurality of elongated longitudinal recessed portions are arranged in an alternating manner transverse to the longitudinal axis. Each of the plurality of raised portion sets are separated from an adjacent one of the plurality of raised portion sets by a transverse recessed portion.

The invention further related to a floor panel having a machine-imparted distressed visible pattern, the floor panel comprising a body extending along a longitudinal axis. The body comprises a bottom surface and a top surface, the top surface having the machine-imparted distressed visible pattern. The machine-imparted distressed visible pattern comprises a plurality of elongated longitudinal raised portions that extend substantially parallel to one another in a spaced apart manner. Each of the plurality of elongated longitudinal raised portions is completely surrounded by a continuous recessed area.

The invention further relates to a floor panel having a machine-imparted distressed visible pattern, the floor panel comprising a body extending along a longitudinal axis. The body comprises a bottom surface and a top surface, the top surface having the machine-imparted distressed visible pattern. The machine-imparted distressed visible pattern comprises a plurality of elongated raised portions that extend substantially parallel to one another in a spaced apart manner. Each of the plurality of elongated longitudinal raised portions is completely surrounded by a continuous recessed area.

DETAILED DESCRIPTION OF THE INVENTION

Figure 1:
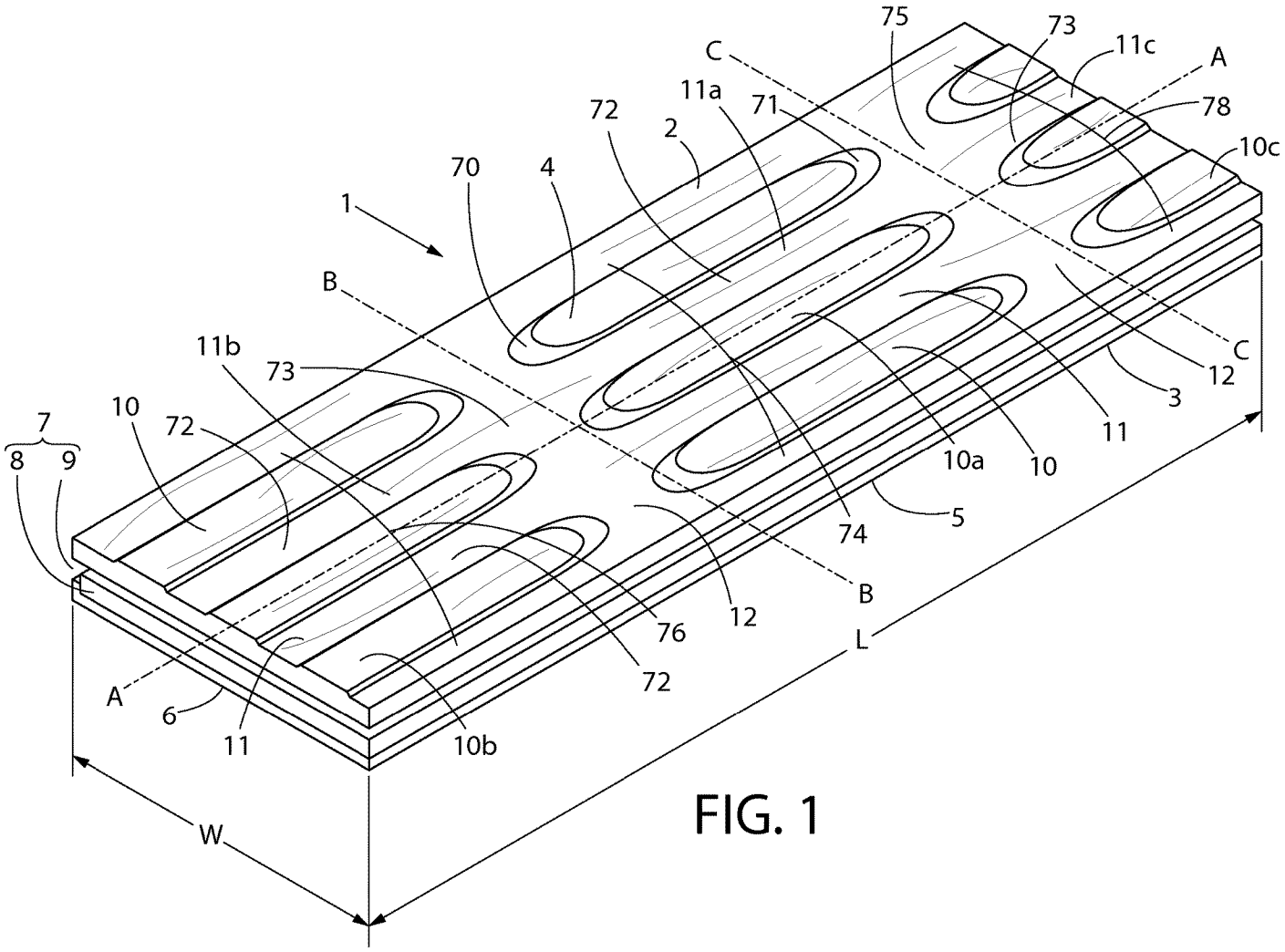
FIG. 1 is a perspective view of a floor structure according to an embodiment of the invention.

FIG. 1 shows a floor structure 1 according to an embodiment of the present invention. The floor structure 1 may be a single ply of solid or engineered hardwood or multiple plies of solid and/or engineered hardwood laminated together. As shown in FIG. 1, the floor structure 1 may be a floor panel 1, having a length L and a width W, comprising a body that extends along a longitudinal axis A-A. The floor panel comprises a top surface 2 and a bottom surface 3. The top surface 2 has a substantially continuous distressed visible pattern 4 formed therein, wherein the distressed visible pattern 4 is machine-imparted.

The machine-imparted distressed visible pattern 4 comprises a plurality of raised portion sets 74, 76, 78. Each of the plurality of raised portion sets 74, 76, 78 comprises a plurality of raised portions 10 and a plurality of recessed portions 11, which are intermittent at varying locations 12. The plurality of raised portions 10 are elongated longitudinally—i.e. elongated longitudinal raised portions 10. The plurality of recessed portions 11 are elongated longitudinally—i.e. elongated longitudinal recessed portions 11. The plurality of elongated longitudinal raised portions 10 extend substantially parallel to one another. In some embodiments, each of the plurality of elongated raised portions 10 may extend substantially parallel to the longitudinal axis A-A. In other embodiments, each of the plurality of elongated raised portions 10 may extend substantially oblique to the longitudinal axis A-A.

The plurality of raised portion sets 74, 76, 78 comprises a first raised portion set 74, a second raised portion set 76, and a third raised portion set 78. A plurality of elongated longitudinal raised portions 10*a* of the first raised portion set 74 are aligned with a plurality of the elongated longitudinal raised portions 10*b* of the second raised portion set 76, as well as a longitudinal raised portions 10*c* of the third raised portion set 78.

The plurality of elongated longitudinal raised portions 10 and the plurality of elongated longitudinal recessed portions 11 are arranged in an alternating manner transverse to the longitudinal axis A-A. Each of the plurality of raised portion sets 74, 76, 78 is separated from an adjacent plurality of raised portion sets 74, 76, 78 by a transverse recessed portion 73, 75. The transverse recessed portions 73, 75 extend substantially parallel to one or more transverse axis B-B, C-C. The transverse recessed portions 73, 75 may optionally extend at an oblique angle to the transverse axis B-B, C-C. The transverse recessed portions comprise a first one of the transverse recessed portion 73 and a second one of the transverse recessed portions 75.

Each one of the raised portions sets 74, 76, 78 comprise a first end 70 and a second end 71. The second end 71 is opposite the first end 70. Each of the plurality of elongated longitudinal recessed portions 11 intersect the first one of the transverse recessed portions 73 located on the first end 70 of the at least one of the plurality of raised portion sets 74. Each of the plurality of elongated longitudinal recessed portions 11 intersect the second one of the transverse recessed portions 75 located on the second end 71 of the at least one of the plurality of raised portion sets 74. At least one of the transverse recessed portions 73, 75 extend across the entire width W of the floor panel.

For each of the plurality of raised portions sets 74, 76, 78, each of the plurality of elongated longitudinal raised portions 10 are isolated from all other of the elongated longitudinal raised portions 10 on the top surface 2. For each of the plurality of raised portions sets 74, 76, 78 each of the plurality of elongated longitudinal raised portions 10 have substantially the same length.

Each of the plurality of elongated longitudinal raised portions 10 has an elongated oval shape when viewed perpendicular to the top surface 2. Each of the plurality of elongated longitudinal raised portions 10 has a convex transverse cross-section. Each of the plurality of elongated longitudinal raised portions 10 has a concave transverse cross-section.

The machine-imparted distressed visible pattern 4 may also comprise the plurality of elongated longitudinal raised portions 10 that extend substantially parallel to one another in a spaced apart manner. Each of the plurality of elongated longitudinal raised portions 10 are completely surrounded by a continuous recessed area 11. The continuous recessed area 11 comprises a plurality of elongated longitudinal recessed portions 11*a*, 11*b*, 11*c* as well as a first transverse recessed portion 73 and second transverse recessed portion 75.

The plurality of elongated longitudinal recessed portions 11*a*, 11*b*, 11*c* may extend substantially parallel to each other. The plurality of elongated longitudinal recessed portions 11*a*, 11*b*, 11*c* may extend substantially parallel to the longitudinal axis A-A. The first and second transverse portions 73, 75 may extend substantially parallel to each other. The first transverse recessed portion 73 is substantially parallel to a first transverse axis B-B, and the second transverse recessed portion 75 substantially parallel to a second transverse axis C-C. In an alternative embodiment, the first and second transverse portions 73, 75 may extend at an oblique angle to the first and second transverse axis B-B, C-C.

The plurality of elongated longitudinal recessed portions 11 and the plurality of elongated longitudinal raised portions 10 are arranged in an alternating manner transverse to the longitudinal axis A-A. At least one of the plurality of elongated longitudinal raised portions 10 is located between the first and the second recessed portions 73, 75. The first, second, and third plurality of elongated longitudinal raised portion sets 74, 76, 78 are separated by the first and second recessed portions 73, 75. The first and second transverse recessed portions 73, 75 extend across the top surface 2 of the floor panel 1 for the entire width W of the floor panel.

The body 1 comprises a first pair of opposing side surfaces 5 and second pair of opposing side surfaces 6. Each of the first pair and second pair of opposing side surfaces 5, 6 extend substantially perpendicular to the top surface 2 and the bottom surface 3. Each of the first pair and second pair of opposing side surfaces 5, 6 optionally comprise a mechanical locking member a locking member 7. The locking member 7 may comprise, for example, a tongue 8 and a groove 9. The tongue 8 and the groove 9 may optionally be provided with locking projections (not shown) and locking recesses (not shown). Because locking members for floor structures are well known in the art, further description thereof has been omitted. Further, it will be appreciated by those skilled in the art that although the floor structure 1 is shown and described herein as having a substantially rectangular or plank shape, that the floor structure 1 could be square or any other geometrical configuration.

The body 1 is formed by a singly ply of wood or multiple plies of wood laminated together.

The floor panel 1 of the present invention comprises a scoop radius of 18 inches—which impacts the topography of the machine-imparted distressed visible pattern 4. The floor panel 1 of the present invention further comprises a target of 5 scoops for a floor panel 1 having a width W of 5 inches, when there is a minimum of 4 scoops made on the floor panel 1. The floor panel 1 of the present invention has a depth of scoop ranging from about 0.005 inches to about 0.010 inches—with a +/− margin of about 0.003 inches.

Figure 2:
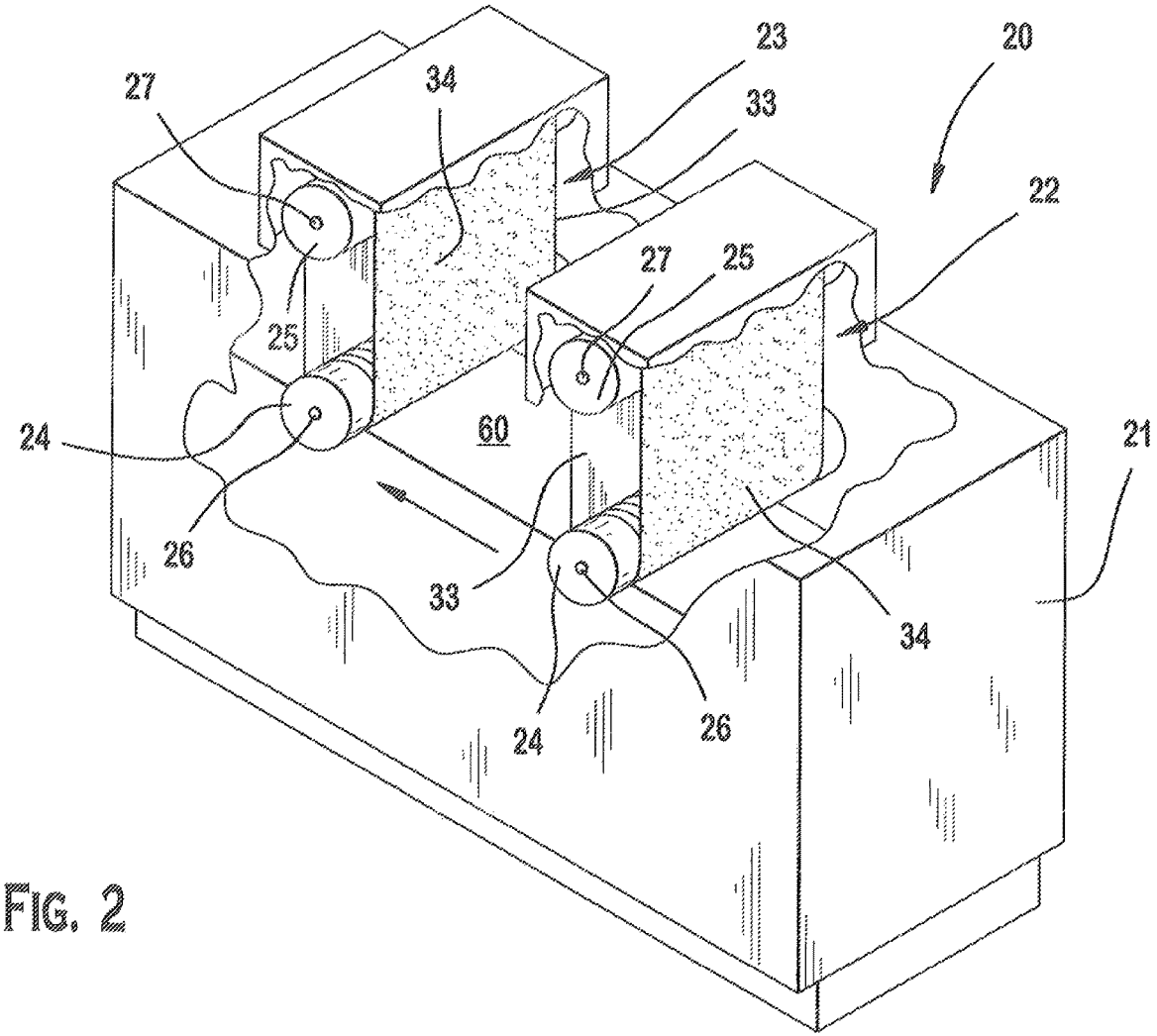
FIG. 2 is a diagrammatic view in partial cut-away of an abrading device according to an embodiment of the invention.

FIG. 2 shows an abrading device 20 for providing the distressed visible pattern 4 on the top surface 2 of the floor structure 1. Because the general structure of the abrading device 20 described herein is well known in the art, only the improvements thereto with respect to providing the distressed visible pattern 4 on the top surface 2 of the floor structure 1 will be described in further detail herein. Examples of conventional abrading devices having the general structure of the abrading device 20 described herein are sold, for example, by Timesavers, Inc. located in Maple Grove, Minn.

As shown in FIG. 2, the abrading device 20 comprises a housing 21 containing a first abrading assembly 22 and a second abrading assembly 23. The first abrading assembly 22 and the second abrading assembly 23 each comprise a contact roll 24 spaced from and positioned substantially underneath an idler roll 25. The contact roll 24 and the idler roll 25 are mounted on substantially parallel shafts 26, 27, respectively, which are supported by a frame 35 (FIG. 3) of the housing 21. The contact roll 24 and the idler roll 35 have a length in a longitudinal direction of about 52 inches. The contact roll 24 of the first abrading assembly 22 has a radius smaller than a radius of the contact roll 24 of the second abrading assembly 23. The contact roll 24 of the first abrading assembly 22 has a radius, for example, of about 7 inches, and the contact roll 24 of the second abrading assembly 23 has a radius, for example, of about 16.5 inches.

Figure 3:
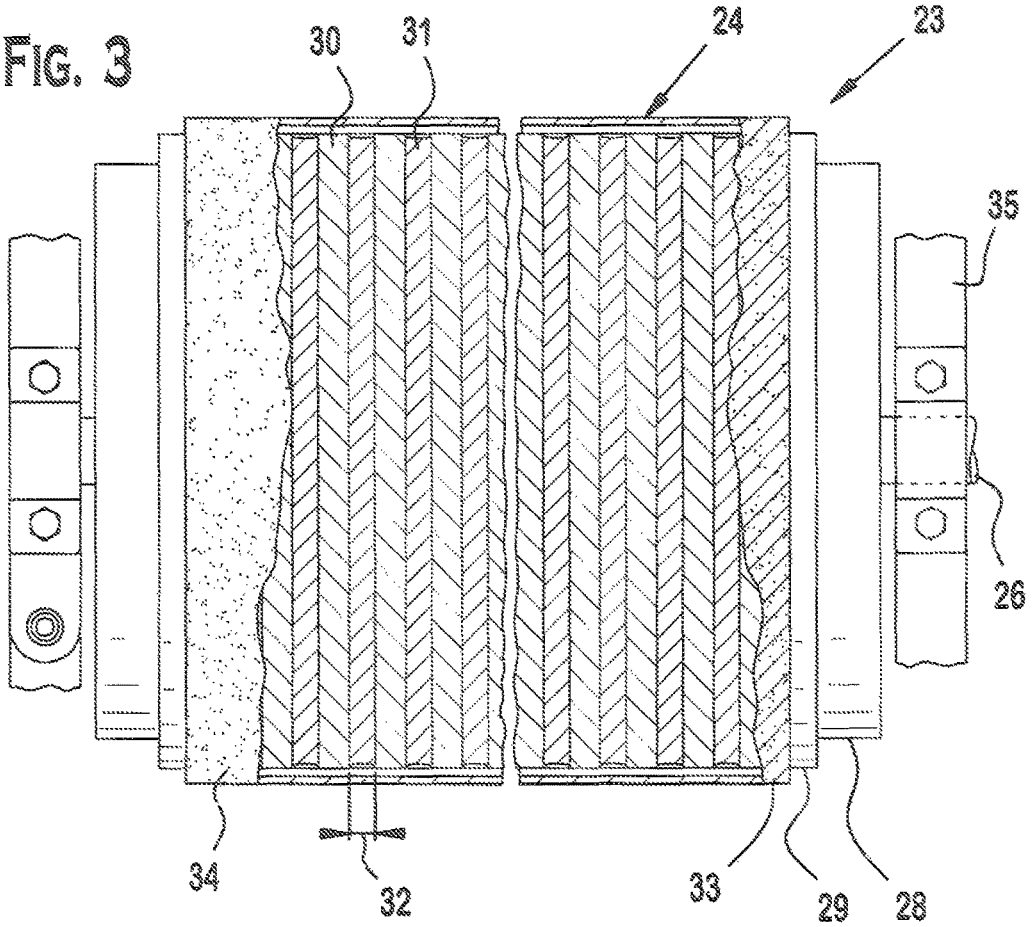
FIG. 3 is a diagrammatic view in partial cut-away of a contact roll of a first abrading assembly and a contact roll of a second abrading assembly of the abrading device.
Figure 3:
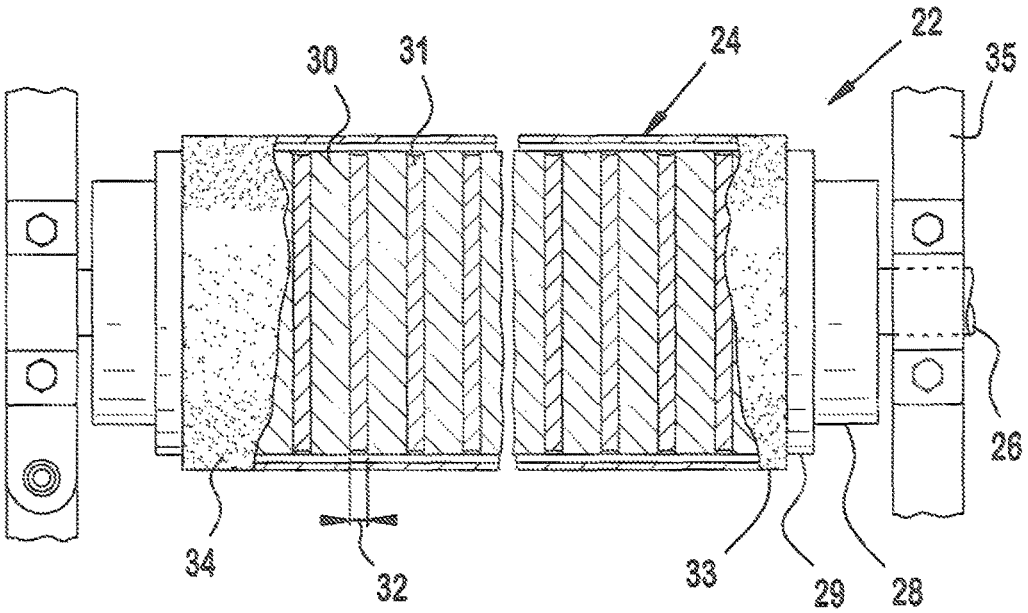

As shown in FIG. 3, each of the contact rolls 24 consists of a cylindrical core 28 configured to axially receive the shaft 26. The core 28 may be formed, for example, from steel tubing. A sleeve 29 encompasses the core 28. The sleeve 29 may be formed from steel, hard plastic, or a rubber material, such as urethane rubber. The sleeve 29 is provided with a plurality of equally spaced and substantially parallel inclined grooves 30 that extend radially about the sleeve 29. The grooves 30 permit radial expansion of the sleeve 29 in response to centrifugal force and dissipate heat. The sleeve 29 is also provided with a plurality of equally spaced and substantially parallel cutouts 31 that extend radially about the sleeve 29 in a direction substantially perpendicular to a longitudinal direction of the sleeve 29. The cutouts 31 are substantially concave in shape and form a substantially scalloped pattern along the longitudinal direction of the sleeve 29. The cutouts 31 are machined into the sleeve 29 over top of the grooves 30.

In the illustrated embodiment, the cutouts 31 of the contact rolls 24 of the first abrading assembly 22 and the second abrading assembly 23 have a depth of about 0.015-0.020 inches. The cutouts 31 of the contact roll 24 of the first abrading assembly 22 have a width 32 smaller than a width 32 of the cutouts 31 of the second abrading assembly 23. For example, the width 32 of the cutouts 31 of the contact roll 24 of the first abrading assembly 22 is about 1.0 inch, and the width of the cutouts 31 of the contact roll 24 of the second abrading assembly 23 is about 1.5 inches. It will be appreciated by those skilled in the art that the length of the contact rolls 24, the radius of the contact rolls 24, the shape of the cutouts 31, the depth of the cutouts 31 and/or the width 32 of the cutouts 31 may be varied depending on the desired appearance of the distressed visible pattern 4 formed on the top surface 2 of the floor structure 1.

As shown in FIG. 2, an abrading belt 33, is trained over the contact roll 24 and the idler roll 25. The abrading belt 33 is tensioned between the contact roll 24 and the idler roll 25, for example, by an actuator (not shown) that moves the idler roll 25 towards and away from the contact roll 24. Because actuators are well known in the art with respect to abrading devices, further description thereof has been omitted. The abrading belt 33 is configured such that the abrading belt 33 substantially covers the contact roll 24 and the idler roll 25. The abrading belt 33 may have a width 32, for example, of about 60 inches and a length, for example, of about 48 inches. The abrading belt 33 is provided with an abrading material 34. In the illustrated embodiment, the abrading belt 33 is, for example, sandpaper having a grit size of about 80-240, and preferably about 120. It will be appreciated by those skilled in the art, however, that the material used for the abrading belt 33, the material used for the abrading material 34, the size of the abrading material 34, and the bond between the abrading belt 33 and the abrading material 34 may be varied depending on the desired appearance of the distressed visible pattern 4 formed on the top surface 2 of the floor structure 1.

Figure 4:
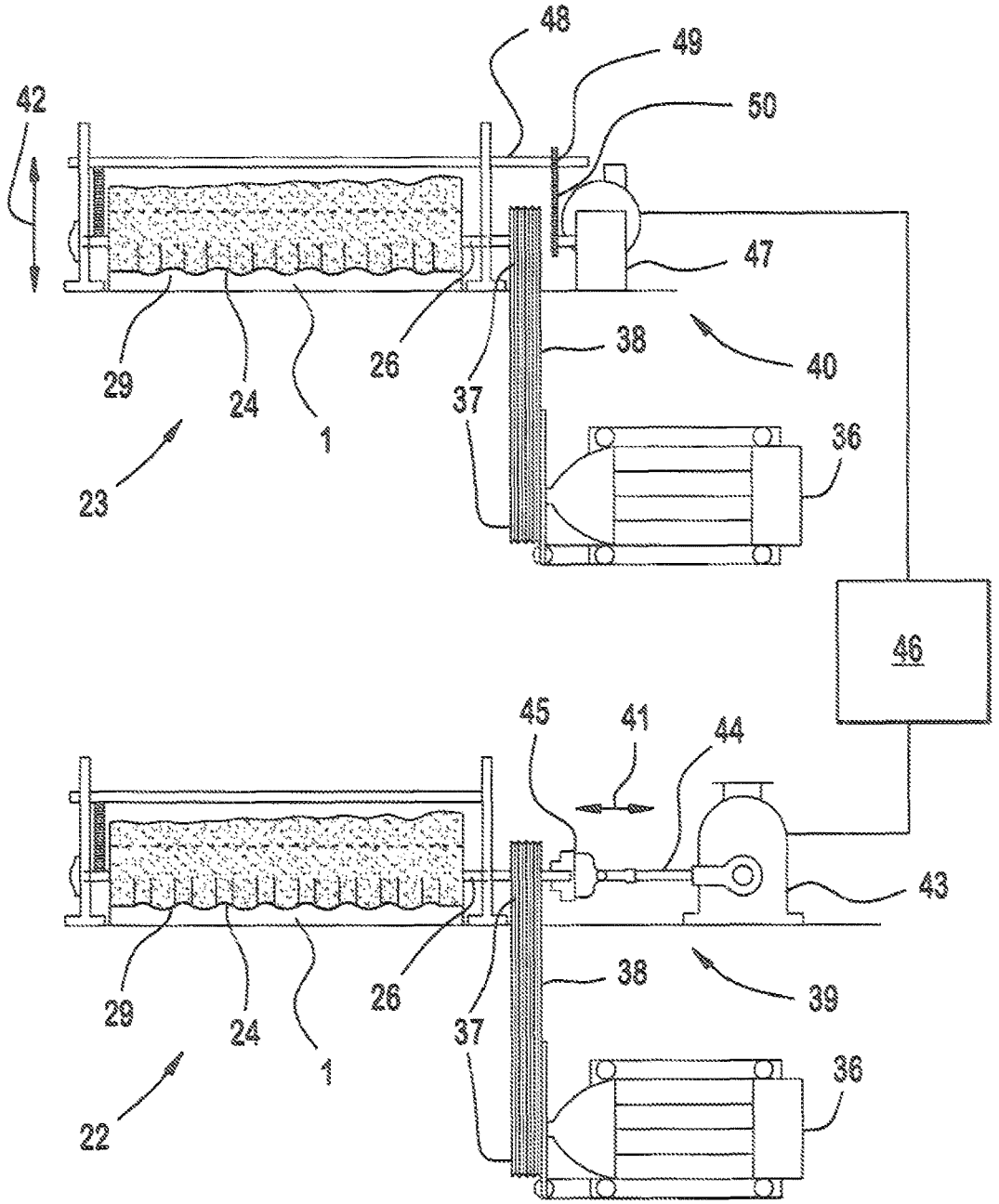
FIG. 4 is diagrammatic view of a first oscillation assembly and a second oscillation assembly of the abrading device.

As shown in FIG. 4, the first abrading assembly 22 and the second abrading assembly 23 are each rotationally driven by a drive motor 36 which is coupled to the shaft 26 of the contact roll 24 via drive pulleys 37 and a drive belt 38. The first abrading assembly 22 and the second abrading assembly 23 are further provided with a first oscillation assembly 39 and a second oscillation assembly 40, respectively. The first oscillation assembly 39 is configured to oscillate the first abrading assembly 22 in a first direction 41 substantially parallel to the longitudinal direction of the sleeve 29 via a linear reciprocating motion. The second oscillation assembly 40 is configured to oscillate the second abrading assembly 23 in a second direction 42 substantially perpendicular to the longitudinal direction of the sleeve 29 via a linear reciprocating motion. In the illustrated embodiment, the first direction 41 is substantially perpendicular to the second direction 42. It will be appreciated by those skilled in the art that there are many conventional methods that can be employed to oscillate the first abrading assembly 22 in the first direction 41 and the second abrading assembly 23 in the second direction 42. For example, in the embodiment shown and described herein, the first abrading assembly 22 and the second abrading assembly 23 are each oscillated via a linear slide. However, other oscillation mechanisms could be used, such as a linear bearing mechanism.

As shown in FIG. 4, the first abrading assembly 22 is oscillated in the first direction 41 via the first oscillation assembly 39, which comprises a variable frequency drive 43 having a cam arm 44 extending there from. The cam arm 44 is attached to the shaft 26 via a cam bearing 45. The cam bearing 45 has an offset of about 0.75 inches such that for every one revolution of the shaft 26 the contact roll 24 is driven about 0.75 inches in the first direction 41. A programmable logic controller 46 is connected to the variable frequency drive 43 of the first oscillation assembly 39. The programmable logic controller 46 controls the timing sequence (whether variable or deliberate) and the speed at which the first abrading assembly 22 is oscillated in the first direction 41.

The second abrading assembly 23 is oscillated in the second direction 42 via the second oscillation assembly 40, which comprises a variable frequency drive 47 coupled to a cam shaft 48 via sprockets 49 and a cam chain 50. The contact roll 24 is driven in the second direction 42 by the eccentric about 0.007-0.012 inches. The programmable logic controller 46 is connected to the variable frequency drive 47 of the second oscillation assembly 40. The programmable logic controller 46 controls the timing sequence (whether variable or deliberate) and the speed at which the second abrading assembly 23 is oscillated in the second direction 42.

As shown in FIG. 1, a conveyor belt 60 is arranged underneath the contact rolls 24 of the first abrading assembly 22 and the second abrading assembly 23. The conveyor belt 60 is supported below the contact rolls 24 by a platen (not shown). A displacement member (not shown) for effecting relative movement between the contact rolls 24 and the platen (not shown) may be further provided beneath the first abrading assembly 22 and the second abrading assembly 23. The displacement member (not shown) is configured to accommodate for different thicknesses of the floor structure 1. Because conveyor belts, platens, and displacement members are well known in the art with respect to abrading devices, further description thereof has been omitted.

Figure 5:
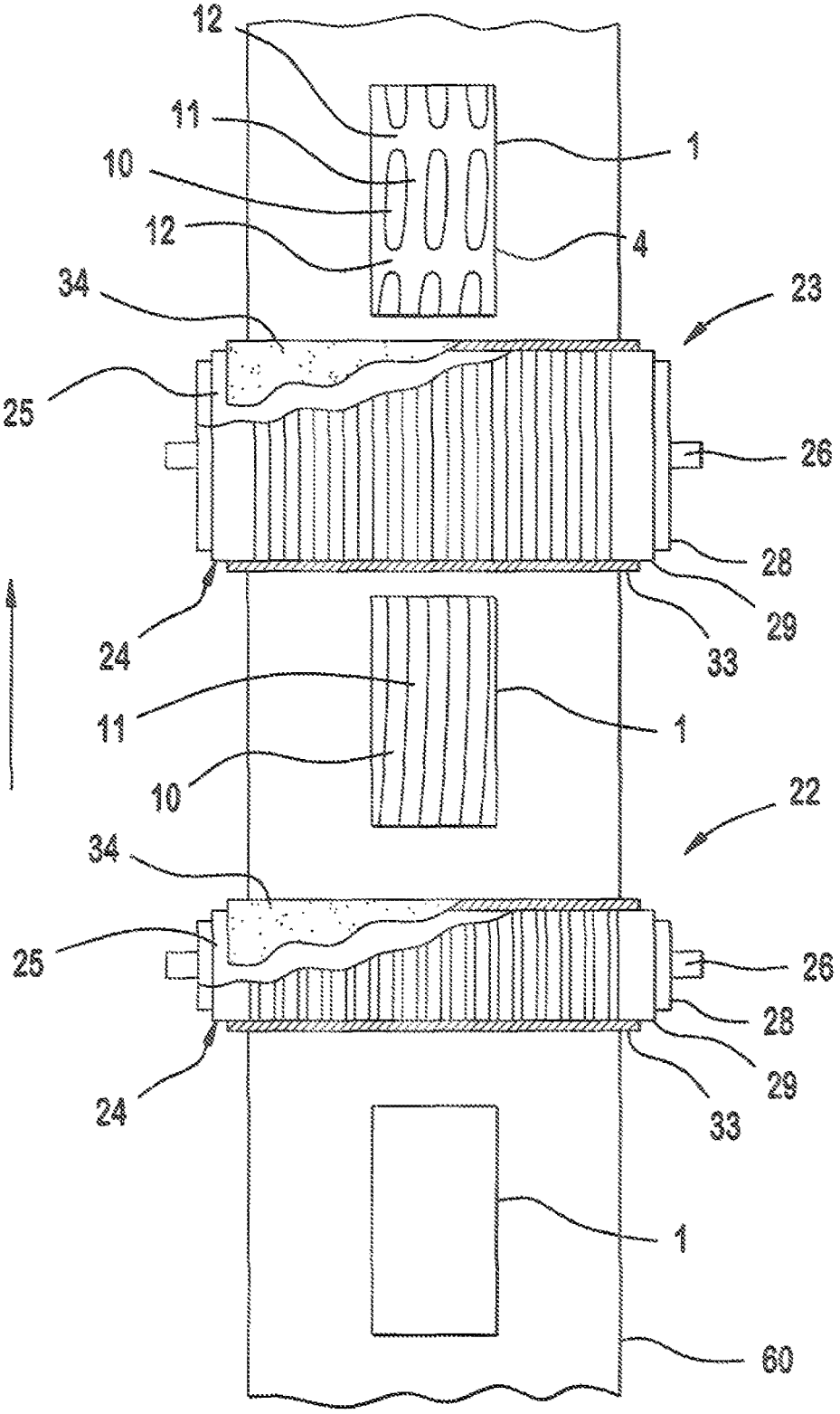
FIG. 5 is a diagrammatic view of a method of forming the floor structure using the abrading device.

A method for providing the distressed visible pattern 4 on the top surface 2 of the floor structure 1 utilizing the abrading device 20 will now be described in greater detail. As shown in FIG. 5, at least one of the floor structures 1 is advanced by the conveyor belt 60 toward and underneath the contact roll 24 of the first abrading assembly 22 such that the top surface 2 of the floor structure 1 has tangential contact with the abrading belt 33 of the first abrading assembly 22. As the abrading belt 33 contacts the top surface 2 of the floor structure 11, the abrading belt 33 deflects into the cutouts 31. As a result, as the contact roll 24 rotates, the abrading belt 33 removes material on the top surface 2 of the floor structure 1 in a pattern corresponding to the pattern formed on the sleeve 29 by the cutouts 31. For example, in the embodiment shown and described herein, a plurality of substantially parallel raised portions 10 and substantially parallel recessed portions 11 are formed on the top surface 2 of the flooring structure 1, wherein the width, height, and location of the raised portions 10 substantial correspond to the width 32, depth, and location of the cutouts 31 on the sleeve 29. Simultaneously, the contact roll 24 is oscillated in the first direction 41 by the first oscillation assembly 39 in response to a signal from the programmable logic controller 46. In the illustrated embodiment, the contact roll 24 is oscillated in a direction substantially parallel to the top surface 2 of the floor structure 1. Thus, the oscillation of the contact roll 24 causes the pattern being formed on the top surface 2 of the floor structure 1 to deviate in the first direction 41. As a result, in the embodiment shown and described herein, the substantially parallel raised portions 10 are inclined in the first direction 41. The amount and timing of the deviation corresponds to the signal from the variable frequency drive 43.

Next, the floor structure 1 is advanced by the conveyor belt 60 toward and underneath the contact roll 24 of the second abrading assembly 23 such that the top surface 2 of the floor structure 1 is in alignment with the contact roll 24. As the floor structure 1 is advanced, the contact roll 24 is oscillated in the second direction 42 by the second oscillation assembly 40 in response to a signal from the programmable logic controller 46. In the illustrated embodiment, the contact roll 24 is oscillated in a direction substantially perpendicular to the top surface 2 of the floor structure 1. As a result, the abrading belt 33 comes into and out of contact with the top surface 2 of the floor structure 1. When the abrading belt 33 contacts the top surface 2 of the floor structure 1, the abrading belt 33 deflects into the cutouts 31. As a result, as the contact roll 24 rotates, the abrading belt 33 removes material on the top surface 2 of the floor structure 1 in a pattern corresponding to the pattern formed on the sleeve 29 by the cutouts 31. For example, in the embodiment shown and described herein, because the top surface 2 of the floor structure 1 already has the raised portions 10 and the recessed portions 11 formed therein, the abrading belt 33 mainly removes material from the raised portions 10 to cause the raised portions 10 to be intermittent at the varying locations 12 with respect to a longitudinal direction of the floor structure 1. The amount and timing of the contact of the abrading belt 33 with the top surface 2 of the floor structure 1 corresponds to the signal from the variable frequency drive 43.

As shown in FIG. 5, after the floor structure 1 exits the abrading device 20, the top surface 2 of the floor structure 1 has the distressed visible pattern 4 formed thereon. The abrading device 20 shown and described herein therefore quickly and cost effectively abrades the top surface 2 of the floor structure 1 to provide an authentic distressed appearance on the top surface 2 thereof. After the distressed visible pattern 4 is formed on the floor structure 1, the floor structure 1 may optionally be run through a finishing line (not shown) where stains and/or top coats, for example, can be applied to the top surface 2 of the floor structure 1.

The foregoing illustrates some of the possibilities for practicing the invention. Many other embodiments are possible within the scope and spirit of the invention. For example, the teachings herein with respect to the abrading device 20 are not solely limited to floor structures. It will be appreciated by those skilled in the art that the abrading device 20 could also be used to provide the distressed visible pattern 4 on other wood or wood-like structures, such as wall or furniture structures. It is, therefore, intended that the foregoing description be regarded as illustrative rather than limiting, and that the scope of the invention is given by the appended claims together with their full range of equivalents.

What is claimed is:

1. A floor panel having a machine-imparted distressed visible pattern, the floor panel comprising:

a body extending along a longitudinal axis;

the body comprising a bottom surface and a top surface, the top surface having the machine imparted distressed visible pattern;

the machine-imparted distressed visible pattern comprising a plurality of raised portion sets, each of the plurality of raised portion sets comprising:

a plurality of elongated longitudinal raised portions that extend substantially parallel to one another;

a plurality of elongated longitudinal recessed portions extending along a recess portion axis, the recess portion axis extending substantially parallel to the longitudinal axis; and the plurality of elongated longitudinal raised portions and the plurality of elongated longitudinal recessed portions arranged in an alternating manner transverse to the longitudinal axis;

wherein each of the plurality of raised portion sets are separated from an adjacent one of the plurality of raised portion sets by a transverse recessed portion that is uninterrupted along an axis transverse to the longitudinal axis.

2. The floor panel of claim 1 wherein for at least one of the plurality of raised portion sets, each of the plurality of elongated longitudinal recessed portions intersects (1) a first one of the transverse recessed portions located on a first end of the at least one of the plurality of raised portion sets; and (2) a second one of the transverse recessed portions located on a second end of the at least one of the plurality of raised portion sets, the second end located opposite the first end.

3. The floor panel of claim 1 wherein for each of the plurality of raised portion sets, each of the plurality of elongated longitudinal raised portions is isolated from all other of the elongated longitudinal raised portions on the top surface.

4. The floor panel of claim 1 for each of the plurality of raised portion sets, each of the plurality of elongated longitudinal raised portions have substantially the same length.

5. The floor panel of claim 1 wherein the body comprises first pair of opposing side surfaces and a second pair of opposing side surfaces, each of the side surfaces of the first and second pairs comprising a mechanical locking member.

6. The floor panel of claim 1 wherein each of the transverse recessed portions extends across an entire width of the floor panel.

7. The floor panel of claim 1 wherein the plurality of raised portion sets comprises a first raised portion set and a second raised portion set; and wherein the plurality of elongated longitudinal raised portions of the first raised portion set are aligned with the plurality of elongated longitudinal raised portions of the second raised portion set.

8. The floor panel of claim 1, wherein the plurality of elongated longitudinal recessed portions extends linearly along the recess portion axis.

9. The floor panel of claim 1, wherein the body comprises a first end opposite a second end and a third end opposite a fourth end, wherein the first end and the second end intersect the third end and the fourth end, and the longitudinal axis intersects the first end and the second end.

10. The floor panel of claim 9, wherein the first and second end have a first length and the third and fourth end have a second length, the second length being greater than the first length.

11. The floor panel of claim 9, wherein the first and second end have a first length and the third and fourth end have a second length, the first length being greater than the second length.

12. A floor panel having a machine-imparted distressed visible pattern, the floor panel comprising:

a body extending along a longitudinal axis;

the body comprising a bottom surface and a top surface, the top surface having the machine-imparted distressed visible pattern;

the machine-imparted distressed visible pattern comprising a plurality of elongated longitudinal raised portions that extend substantially parallel to one another in a spaced apart manner, each of the plurality of elongated longitudinal raised portions being completely surrounded by a continuous recessed area; and wherein the continuous recessed area comprises a plurality of elongated longitudinal recessed portions extending along a recess portion axis, the recess portion axis extending substantially parallel to the longitudinal axis, and wherein the plurality of elongated raised portions are arranged in a plurality of sets and each of the plurality of raised portion sets are separated from an adjacent one of the plurality of raised portion sets by a transverse recessed portion that is uninterrupted along an axis transverse to the longitudinal axis.

13. The floor panel of claim 12 wherein the continuous recessed area comprises and first and second transverse recessed portions; wherein the plurality of elongated longitudinal recessed portions and the plurality of elongated longitudinal raised portions are arranged in an alternating manner transverse to the longitudinal axis; and wherein the plurality of elongated longitudinal raised portions are located between the first and second transverse recessed portions.

14. The floor panel of claim 13 wherein each of the first and second transverse recessed portions extend across the top surface of the floor panel for the entire width of the floor panel.

15. The floor panel of claim 14 wherein the body comprises first pair of opposing side surfaces and a second pair of opposing side surfaces, each of the side surfaces of the first and second pairs comprising a mechanical locking member.

16. The floor panel of claim 12, wherein the plurality of elongated longitudinal recessed portions extends linearly along the recess portion axis.

17. The floor panel of claim 12, wherein the body comprises a first end opposite a second end and a third end opposite a fourth end, wherein the first end and the second end intersect the third end and the fourth end and the longitudinal axis intersects the first end and the second end.

18. The floor panel of claim 17, wherein the first and second end have a first length and the third and fourth end have a second length, the second length being greater than the first length.

19. The floor panel of claim 17, wherein the first and second end have a first length and the third and fourth end have a second length, the first length being greater than the second length.

20. A floor panel having a machine-imparted distressed visible pattern, the floor panel comprising:

a body extending along a longitudinal axis;

the body comprising a bottom surface and a top surface, the top surface having the machine-imparted distressed visible pattern;

the machine-imparted distressed visible pattern comprising a plurality of elongated raised portions that extend substantially parallel to one another in a spaced apart manner, each of the plurality of elongated longitudinal raised portions being completely surrounded by a continuous recessed area; and wherein the continuous recessed area comprises a plurality of elongated longitudinal recessed portions extending along a recess portion axis, the recess portion axis extending substantially parallel to the longitudinal axis, and wherein the plurality of elongated raised portions are arranged in a plurality of sets and each of the plurality of raised portion sets are separated from an adjacent one of the plurality of raised portion sets by a transverse recessed portion that is uninterrupted along an axis transverse to the longitudinal axis.

* * * * *